US007401648B2

(12) United States Patent
Richard

(10) Patent No.: US 7,401,648 B2
(45) Date of Patent: Jul. 22, 2008

(54) ONE TRIP WELL APPARATUS WITH SAND CONTROL

(75) Inventor: Bennett Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 248 days.

(21) Appl. No.: 11/153,850

(22) Filed: Jun. 13, 2005

(65) Prior Publication Data

US 2005/0284633 A1 Dec. 29, 2005

Related U.S. Application Data

(60) Provisional application No. 60/579,818, filed on Jun. 14, 2004.

(51) Int. Cl.
*E21B 43/04* (2006.01)

(52) U.S. Cl. ..... 166/278; 166/51

(58) Field of Classification Search ..... 166/278, 166/51, 305.1, 306, 100, 376; 175/314
See application file for complete search history.

(56) References Cited

U.S. PATENT DOCUMENTS

| | | | |
|---|---|---|---|
| 2,855,049 | A | 10/1958 | Zandmer |
| 2,913,052 | A | 11/1959 | Harmon |
| 3,224,506 | A | 12/1965 | Huitt et al. |
| 3,245,472 | A | 4/1966 | Zandmer |
| 3,301,337 | A | 1/1967 | Vaughn et al. |
| 3,347,317 | A | 10/1967 | Zandmer |
| 3,390,724 | A | 7/1968 | Caldwell |
| 3,425,491 | A | 2/1969 | Zandmer |
| 4,285,398 | A | 8/1981 | Zandmer et al. |
| 4,750,571 | A | 6/1988 | Geeting |
| 4,825,944 | A | 5/1989 | Mays |
| 5,165,478 | A | 11/1992 | Wilson |
| 5,228,518 | A | 7/1993 | Wilson et al. |
| 5,425,424 | A | 6/1995 | Reinhardt et al. |
| 5,445,220 | A | 8/1995 | Gurevich et al. |
| 5,632,348 | A | 5/1997 | Yunan |
| 5,823,254 | A | 10/1998 | Dobson et al. |
| 5,829,520 | A | 11/1998 | Johnson |
| 5,884,702 | A | 3/1999 | Yokley et al. |
| 5,947,200 | A | 9/1999 | Montgomery |
| 6,006,838 | A | 12/1999 | Whiteley et al. |
| 6,009,947 | A | 1/2000 | Wilson et al. |

(Continued)

FOREIGN PATENT DOCUMENTS

| | | |
|---|---|---|
| GB | 2277337 | 10/1994 |

(Continued)

OTHER PUBLICATIONS

Fuller, M. S., et al.; Innovative Way to Cement a Liner Utilizing a New Inner String Liner Cementing Process; 1998 IADC/SPE Conference, Mar. 3-6; Dallas, Texas; pp. 501-504.

*Primary Examiner*—William P Neuder
(74) *Attorney, Agent, or Firm*—Steve Rosenblatt

(57) ABSTRACT

An apparatus and method for drilling a well bore, placing a liner, cementing and perforating the liner, and injecting or producing fluid, sand-free, through the perforations. The liner has a plurality of outwardly extendable elements for perforation and sand control. The tool also can have a drilling apparatus, a cementing apparatus, a steering apparatus and a formation evaluation apparatus.

21 Claims, 2 Drawing Sheets

U.S. PATENT DOCUMENTS

| | | | | |
|---|---|---|---|---|
| 6,164,126 | A * | 12/2000 | Ciglenec et al. | 73/152.01 |
| 6,408,945 | B1 | 6/2002 | Telfer | |
| 6,732,806 | B2 | 5/2004 | Mauldin et al. | |
| 6,766,858 | B2 | 7/2004 | Nguyen et al. | |
| 6,799,645 | B2 | 10/2004 | Mason et al. | |
| 7,108,083 | B2 * | 9/2006 | Simonds et al. | 175/57 |
| 2003/0136562 | A1 | 7/2003 | Robison et al. | |
| 2005/0194143 | A1 * | 9/2005 | Xu et al. | 166/285 |

FOREIGN PATENT DOCUMENTS

| | | |
|---|---|---|
| WO | WO 03/052238 | 6/2003 |
| WO | WO 03/104611 | 12/2003 |
| WO | 2005/056977 | 6/2005 |

* cited by examiner

ONE TRIP WELL APPARATUS WITH SAND CONTROL

CROSS REFERENCE TO RELATED APPLICATIONS

This application relies upon U.S. Provisional Patent Application No. 60/579,818, filed on Jun. 14, 2004, and entitled "One Trip Well Apparatus with Sand Control."

STATEMENT REGARDING FEDERALLY SPONSORED RESEARCH OR DEVELOPMENT

Not Applicable

BACKGROUND OF THE INVENTION

1. Field of the Invention

The present invention is in the field of apparatus and methods used in drilling and completing an oil or gas well, and producing hydrocarbons from the well or injecting fluids into the well.

2. Background Art

In the drilling and completion of oil and gas wells, it is common to drill a well bore, position a liner in the well bore, cement the liner in place, perforate the liner at a desired depth, and provide for the sand free production of hydrocarbons from the well or the injection of fluids into the well. These operations are typically performed in several steps, requiring multiple trips into and out of the well bore with the work string. Since rig time is expensive, it would be helpful to be able to perform all of these operations with fewer trips into the well bore.

BRIEF SUMMARY OF THE INVENTION

The present invention provides a tool and method for drilling a well bore, placing and perforating a well bore liner, cementing the liner in place, and producing or injecting fluids, sand-free. The apparatus includes a tubular liner having a plurality of radially outwardly extendable tubular elements, with a drilling apparatus for drilling a well bore below the liner, a cementing apparatus for cementing the liner in place, and a temporarily blocked sand control medium in the outwardly extendable elements for selectively controlling the sand-free injection or production of fluids through the extendable elements. The drilling apparatus can be concentric to the production liner back to surface, concentric to several nested liners or attached to the top of the production liner with a release mechanism known by those skilled in the art.

One embodiment of the apparatus has a drilling shoe formed or mounted at the lower end of the liner. In this embodiment, the liner is attached to a rotatable drill string, and the cementing apparatus, of a type known in the art, is incorporated in the drill string. After drilling, the drill string provides a conduit for the cement and for the fluids produced from or injected into the well if production tubing is not a requirement.

Another embodiment of the apparatus has a drill bit which is driven by a downhole motor. In this embodiment, the drill bit and downhole motor drill the well bore, with the liner mounted thereto, and with the drill bit extendable below the liner. After drilling, the drill bit and the downhole motor can be released from the liner and withdrawn from the well bore. Also, in this embodiment, the cementing apparatus, again of a type known in the art, can be lowered into the well, after withdrawal of the drill bit and the downhole motor. In this embodiment, a separate tubular can provide a conduit for the cement and for the fluids produced from or injected into the well.

In either embodiment, the outwardly extendable tubular elements in the liner are filled with a sand control medium, such as a gravel pack material. The outwardly extendable tubular elements are also initially blocked by a blocking medium, such as a wax material, which initially prevents fluid flow through the outwardly extendable elements. Alternatively, rather than a wax material, the blocking medium can be a biodegradable material, such as a biodegradable polymer, or a frangible disk. After the liner is in place in the well bore, the outwardly extendable tubular elements are extended into contact with the wall of the well bore in the desired formation, after which the liner is cemented in place and the blocking medium is removed from the outwardly extendable tubular elements. Removal of a wax blocking medium can be accomplished by application of heat or a fluid to the wax material to dissolve it. Removal of a biodegradable blocking medium can be by biodegradation of the blocking medium in the presence of downhole fluids or other fluids, at downhole temperatures, thereby dissolving the blocking medium. Removal of a frangible disk can be by fracturing of the disk with increased fluid pressure. After removal of the blocking medium, fluids can be produced from the formation or injected into the formation, through the outwardly extendable tubular elements.

The liner with the outwardly extendable tubular elements can be the innermost tubular in a nested string of tubulars. During drilling, the liner extends downwardly from the nested string into the well bore. The assembly can also be provided with a steering capability and a formation evaluation capability, both of which features are separately known in the art.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
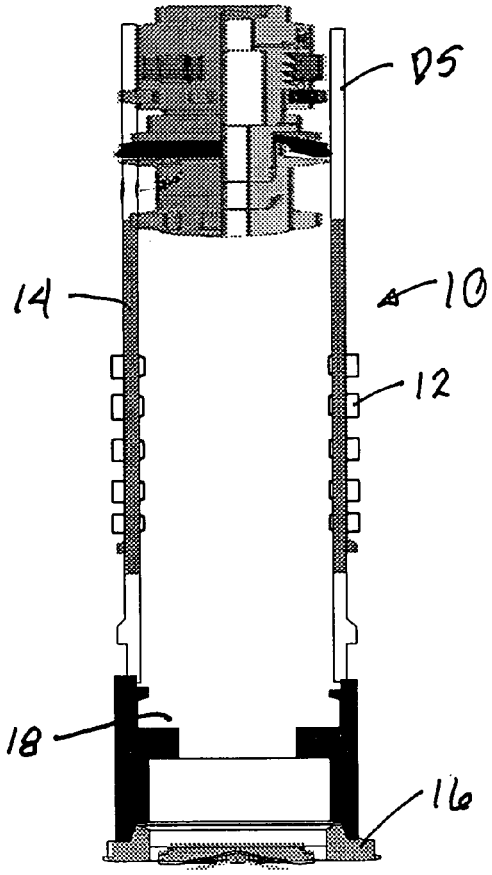
FIG. 1 is a longitudinal section view of a first embodiment of the apparatus of the present invention, in the run-in condition.

As shown in FIG. 1, in one embodiment, the tool 10 of the present invention includes a liner 14, which has a plurality of outwardly extendable tubular elements 12. All of these outwardly extendable elements 12 are shown retracted radially into the liner 14 of the tool 10, in the run-in position. A drilling tool 16, such as a drillable shoe, is mounted to the lower end of the liner 14. The liner 14 is mounted on a drill string DS, which can be rotated by a drilling rig (not shown). A cementing apparatus 18, of any type known in the art, can be incorporated in the drill string DS below the liner 14.

As the liner 14 is rotated, the drilling tool 16 drills a well bore to the desired depth. The liner 14 can be incorporated within a nested string of tubulars (not shown). In this case, as the liner 14 and the drilling tool 16 progress into the well bore, the nested string of tubulars follows, creating an extended casing string in the well bore.

Figure 2:
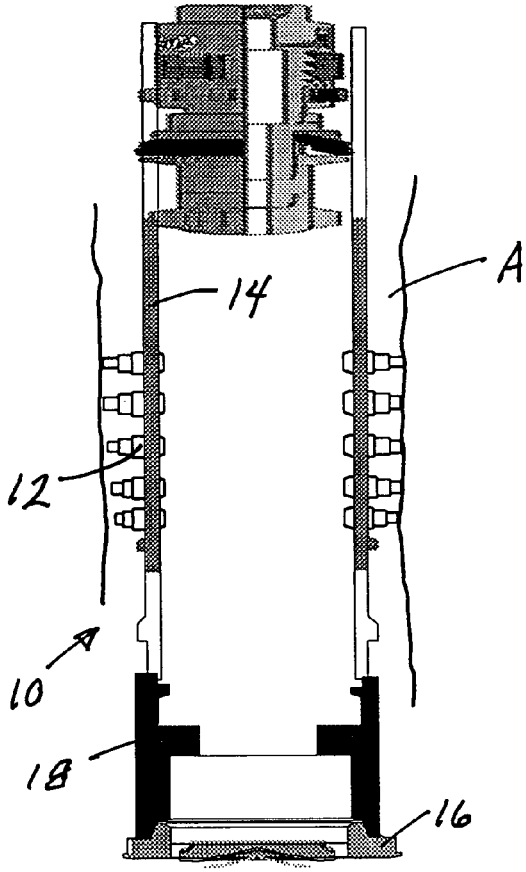
FIG. 2 is a longitudinal section view of the apparatus in FIG. 1, showing the extendable tubular elements extended outwardly and the liner cemented in place.

As shown in FIG. 2, once the liner 14 is at the desired depth, the outwardly extendable elements 12 are extended radially outwardly from the body of the tool 10 to contact the underground formation, such as by the application of hydraulic pressure from the fluid flowing through the tool 10. If any of the elements 12 fail to fully extend upon application of this hydraulic pressure, they can be mechanically extended by the passage of a tapered plug (not shown) through the body of the tool 10, as is known in the art, but this requires a separate trip. After extension of the outwardly extendable elements 12 to contact the formation, cementing the liner in place can be accomplished by pumping cement into the annulus between the liner 14 and the well bore, with the cementing apparatus 18, as is known in the art.

Figure 3A:
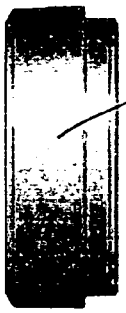
FIGS. 3A, 3B, and 3C are side views of a typical outwardly extendable tubular element incorporated in the apparatus of the present invention.
Figure 3B:
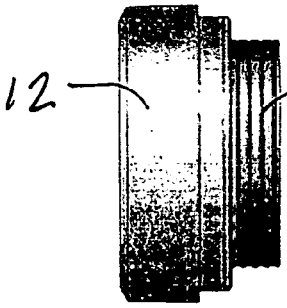
Figure 3C:
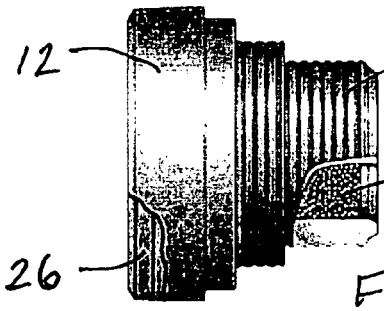

FIGS. 3A, 3B, and 3C show the extension of a typical extendable tubular element 12. FIG. 3A shows the extendable element 12 in the withdrawn condition, as it is configured when the tool 10 is in its run-in configuration. FIG. 3B shows the extendable element 12 with a first extension 20 extended to contact the wall of a full gauge well bore, as normally drilled. FIG. 3C shows the extendable element 12 with a second extension 22 extended as may be necessary to contact the wall of a washed out well bore.

It can be seen that the tubular elements 12 have an open central bore for the passage of fluid. As also shown in FIG. 3C, the tubular elements 12 have a sand control medium 24 incorporated therein. The sand control medium 24 prevents intrusion of sand or other particulate matter from the formation into the tool body. The tubular elements 12 can have any type of built-in sand control medium 24 therein, including any gravel pack material known in the art, metallic beads, or a mechanical screening element.

The tubular elements 12 also have a blocking medium 26 therein, such as a wax material, a polymer material, a frangible disk, or any combination thereof. As originally constituted, the blocking medium blocks any fluid flow through the outwardly extendable elements. The blocking medium 26 is next to the inside of the liner 14, to provide a pressure barrier enabling the hydraulic extension of the tubular elements 12. Where a wax material is used as the blocking medium 26, the wax can be susceptible to removal by the application of heat or exposure to a fluid which can dissolve the wax. Where a polymer material is used as the blocking medium 26, it can be a material which is biodegradable in fluids which may be found in the well bore, or which can be pumped into the well bore. A polymer material could also be chosen which is susceptible to removal by the application of heat. Where a frangible disk is chosen for the blocking medium, it can be designed to rupture upon application of a given fluid pressure.

Once the liner 14 has reached the desired depth and the tubular elements 12 have been extended to contact the bore hole wall. Cement can then be pumped via the cementing apparatus 18 to fill the annulus between the liner 14 and the bore hole wall. The blocking medium 26 is removed in a fashion depending upon which type of blocking medium is used. Thereafter, hydrocarbon fluids can be produced from the formation through the outwardly extendable elements 12, or fluid can be injected into the formation through the outwardly extendable elements 12.

Figure 4:
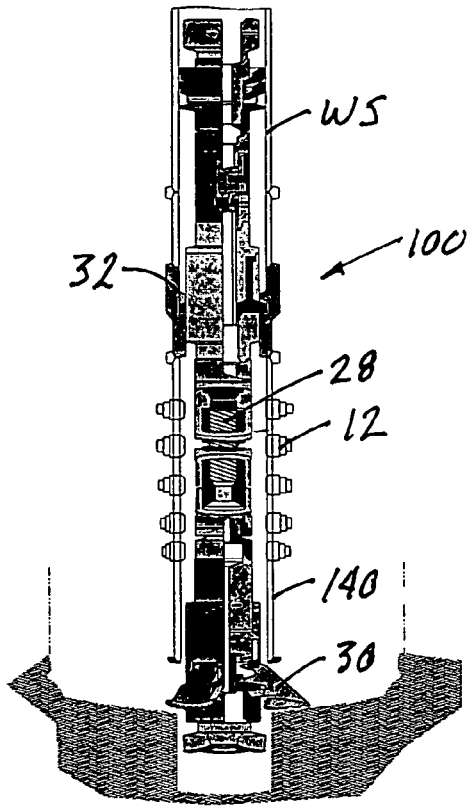
FIG. 4 is a longitudinal section view of a second embodiment of the apparatus of the present invention.

FIG. 4 shows a second embodiment of the tool 100 of the present invention. In this embodiment, the liner 140 does not rotate for the purpose of drilling the well bore. Instead, the liner 140 is lowered into the well bore while the bore is being drilled by a downhole motor 28, on a work string WS. The liner 140 can be attached to the work string WS by a releasable connector 32. The downhole motor 28 drives a drilling tool 30 extending below the lower end of the liner 140. The drilling tool 30 can include a hole opener if desired. Directional drilling apparatus and formation evaluation equipment can be incorporated in the work string WS, as is known in the art. Further, the liner 140, as in the first embodiment, can be incorporated in a nested string of tubulars (not shown). In this embodiment, after drilling and placement of the liner 140, and after extension of the outwardly extendable tubular elements 12, the downhole motor and the drilling tool 30 can be removed. Then, a cementing apparatus can be introduced, for cementing the liner 140 in place, as described above, or cementing can be done with the work string WS and the drill string DS in place. Thereafter, hydrocarbon fluids can be produced from the formation through the outwardly extendable elements 12, or fluid can be injected into the formation through the outwardly extendable elements 12.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. An apparatus for one trip drilling and completion of a well, comprising:

a tubular having at least one opening and an extendable sand control device associated with said opening, said sand control device comprising an outwardly extending tubular element selectively extendable relative to said opening where it is mounted;

a drilling apparatus further comprising a drill string supporting at least one bit, said drilling apparatus rotating and advancing said tubular as said bit drills the well; and a temporary blocking medium for said sand control device said blocking medium being adapted to initially block fluid flow through said sand control device as said sand control device is extended and said tubular is externally sealed in the well with a sealing material delivered through it and to subsequently allow fluid flow through said extended sand control device and said now externally sealed tubular after said sealing material has set up.

2. The apparatus recited in claim 1, further comprising:

an apparatus adapted to pump a sealing material through said tubular to seal said tubular in place in a well bore.

3. The apparatus recited in claim 2, wherein said sealing material is cement.

4. The apparatus recited in claim 2, wherein said tubular is mounted to a rotatable drill string.

5. The apparatus recited in claim 4, wherein:

said sealing apparatus is incorporated within said drill string; and said drilling apparatus comprises a drilling tool mounted to a lower end of said tubular.

6. The apparatus recited in claim 2, wherein:

said tubular is mounted to a production string; and said drilling apparatus comprises a drilling tool driven by a downhole motor.

7. The apparatus recited in claim 6, wherein:

said drilling tool is adapted to pass through, and extend below, said tubular; and said sealing apparatus is adapted to pass through said production string after removal of said drilling apparatus.

8. The apparatus recited in claim 1, wherein:

said sand control device comprises a gravel pack material.

9. The apparatus recited in claim 1, wherein:

said temporary blocking medium comprises a wax material, said wax material being removable by application of an agent selected from the following: an acid, a hydrocarbon, or heat.

10. The apparatus recited in claim 1, wherein:

said temporary blocking medium comprises a polymer material, said polymer material being removable by biodegradation.

11. The apparatus recited in claim 1, wherein:

said temporary blocking medium comprises a frangible disk.

12. A method for one trip drilling and completion of a well, comprising:

providing a tubular with an extendable sand control medium and a temporary blocking medium for at least one opening thereon;

providing a drilling apparatus discrete from said tubular that supports said tubular;

drilling a well bore with a bit on said drilling apparatus while selectively advancing said tubular with said drilling apparatus;

extending said sand control medium;

cementing said tubular when said drilling places it in a desired position and said sand control medium is extended;

partially or totally disabling said blocking medium after said cementing; and passing fluid through said opening.

13. The method recited in claim 12, further comprising:

initially blocking fluid flow through said opening with said blocking medium; and removing said blocking medium to subsequently allow fluid flow through said opening.

14. The method recited in claim 12, wherein:

mounting said tubular to a rotatable drill string which further comprises a drilling tool mounted to a lower end of said tubular; and rotating said tubular and said drilling tool with said drill string.

15. The method recited in claim 12, wherein:

mounting said tubular to a production string and providing as said drilling apparatus a drilling tool driven by a downhole motor.

16. The method recited in claim 15, wherein:

passing said drilling tool through said tubular; and rotating said drilling tool with said downhole motor.

17. The method recited in claim 16, further comprising:

removing said drilling apparatus from said production string after said drilling;

providing a cementing apparatus;

pumping cement through said tubular with said cementing apparatus to cement said tubular in place in the well bore;

lowering said cementing apparatus through said production string prior to pumping said cement.

18. The method recited in claim 12, wherein:

providing as said temporary blocking medium a wax material; and removing said blocking medium by dissolving said wax material or by application of an acid, a hydrocarbon, or heat.

19. The method recited in claim 12, wherein:

providing as said temporary blocking medium a polymer material; and removing said blocking medium by biodegradation of said polymer material.

20. The method recited in claim 12, wherein:

providing as said temporary blocking medium a frangible disk; and removing said blocking medium by rupturing of said frangible disk.

21. The method of claim 12, comprising:

providing an outwardly telescoping tubular element associated with each said opening;

and disposing said sand control medium and said temporary blocking medium in a passage of said telescoping tubular element.

* * * * *